US007518028B2

(12) United States Patent
Loyd et al.

(10) Patent No.: US 7,518,028 B2
(45) Date of Patent: Apr. 14, 2009

(54) RADIATION SHIELDS AND TECHNIQUES FOR RADIATION SHIELDING

(75) Inventors: Dennis Dean Loyd, West Chester, OH (US); Larry Lee Lough, Springdale, OH (US); Roger E. Hayner, Hebron, KY (US); Phillip R. Terry, Hamilton, OH (US)

(73) Assignee: Terry Asphalt Materials, Inc., Hamilton, OH (US)

( * ) Notice: Subject to any disclaimer, the term of this patent is extended or adjusted under 35 U.S.C. 154(b) by 521 days.

(21) Appl. No.: 11/256,878

(22) Filed: Oct. 24, 2005

(65) Prior Publication Data

US 2009/0069620 A1 Mar. 12, 2009

Related U.S. Application Data

(63) Continuation of application No. 10/835,504, filed on Apr. 29, 2004, now abandoned.

(51) Int. Cl.
*G21F 9/16* (2006.01)

(52) U.S. Cl. ..... 588/5; 588/3; 588/20; 588/15; 588/313

(58) Field of Classification Search ..... 588/3, 588/5, 20, 15, 313; 423/183, 278; 250/506.1, 250/507.1; 422/1–3; 523/136; 252/478
See application file for complete search history.

(56) References Cited

U.S. PATENT DOCUMENTS

| | | | | | |
|---|---|---|---|---|---|
| 3,716,490 | A | * | 2/1973 | Van de Voorde | 588/5 |
| 4,252,667 | A | * | 2/1981 | Stegmaier et al. | 588/5 |
| 4,569,787 | A | * | 2/1986 | Horiuchi et al. | 588/20 |
| 4,594,513 | A | * | 6/1986 | Suzuki et al. | 250/506.1 |
| 4,847,008 | A | * | 7/1989 | Boatner et al. | 588/11 |
| 5,008,311 | A | * | 4/1991 | Janoski | 524/59 |

FOREIGN PATENT DOCUMENTS

| | | | |
|---|---|---|---|
| DE | 4302536 | A1 | 8/1994 |
| FR | 2562887 | A1 | 10/1985 |
| FR | 2619654 | A1 | 2/1989 |
| FR | 2718882 | A1 | 10/1995 |
| FR | 2776283 | A1 | 9/1999 |
| WO | WO-9719871 | A1 | 6/1997 |
| WO | WO-2005055624 | A2 | 6/2005 |

* cited by examiner

*Primary Examiner*—Jennifer McNeil
*Assistant Examiner*—Smita Patel
(74) *Attorney, Agent, or Firm*—Schwegman, Lundberg & Woessner, P.A.

(57) ABSTRACT

Radiation shields and techniques for radiation shielding are provided. Bitumen substances, such as asphalt or tar, are mixed with radioactive waste, leaded glass, or a radioactive waste and leaded glass composite. In embodiments where the bitumen substance is mixed with leaded glass, the resulting mixture can be coated onto containers that house radioactive waste or the resulting mixture can be coated onto the outer surface of the radioactive waste.

10 Claims, 3 Drawing Sheets

RADIATION SHIELDS AND TECHNIQUES FOR RADIATION SHIELDING

RELATED APPLICATION

The present invention claims priority to and is a continuation of U.S. application Ser. No. 10/835,504 filed on Apr. 29, 2004 now abandoned and entitled: "Radiation Shields and Techniques for Radiation Shielding." The disclosure of U.S. application Ser. No. 10/835,504 is incorporated by reference herein.

FIELD OF THE INVENTION

The present invention is related to radiation protection, and more particularly to radiation shields and techniques for radiation shielding.

BACKGROUND OF THE INVENTION

Radioactive waste is materials that are radioactive and for which there is no further use available. Radioactive materials give off harmful energy (x-rays, gamma rays, and others) in the form of waves, rays or particles. Radioactive waste is produced from laboratory activities or commercial activities. Radioactive waste can include high-level and low-level radioactive waste. High-level waste includes radioactive waste left in a nuclear reactor after nuclear fuel has been consumed. Low-level waste includes objects or materials that have been exposed to radiation and remain contaminated.

Managing radioactive waste is a major world industry that is heavily regulated and controlled by government agencies. Exposure to energy associated with radioactive waste can cause death, birth defects, mass evacuations of geographic areas, and severe catastrophic illnesses, such as cancer. Moreover, each time a radioactive waste disposal company attempts to dispose of radioactive waste they are subject to mass protests by citizens and environmental organizations. As a result, nuclear power and other energy that produces harmful radiation have not been as widely deployed as governments had originally desired and anticipated.

However, radioactive waste continues to be produced at alarming rates. One reason is that the time period during which radioactive waste remains harmful is extremely long, several lifetimes. Thus, containers and methods used to house the radioactive waste often deteriorate long before the radioactive waste becomes harmless.

There are a variety of techniques that are used to contain and store radioactive waste. Some examples include producing synroc or synthetic rock composites that include or encapsulate the radioactive waste. One notable technique is to mix radioactive waste with cement to produce a radioactive cement block. The cement is then further sealed with paints that help contain the radioactive waste.

Another technique is to thicken radio active waste, such as radioactive waste treatment water and then seal the waste water in large containers. These containers can deteriorate over many years of storage or can become punctured. The radioactive waste is then capable of seeping into the environment and creating potential deadly exposure to humans and the environment.

Conventional disposal techniques are expensive, time consuming, and do not yield the kind of results that the waste industry and governments had anticipated. Synroc can deteriorate and thickeners often include heavy metals that can leach into the environment when subject to normal environmental conditions over time. In fact, many techniques will specifically produce or mine raw metals or other materials for the purpose of using these metals or materials in combination with a radioactive waste disposal process. The production or mining of these special metals and materials add substantially to the costs associated with disposing of radioactive waste. In fact, one primary reason why nuclear or alternative energies have not been more wide spread in their applications is because of the expense associated with safely disposing of the radioactive waste.

Accordingly, there is a need for less-expensive materials and techniques that can assist in improving the safe disposal of radioactive waste.

SUMMARY OF THE INVENTION

Briefly and in general terms, bitumen substances are either directly mixed with radioactive waste, mixed with a combination of leaded glass and radioactive waste, or mixed with leaded glass and used as a sealant or a coating to contain radioactive waste. The asphalt and/or leaded glass are integrated into conventional radiation waste disposal systems. The glass includes lead and other heavy metals (e.g., barium, bismuth, iron, tungsten, or other alloys thereof) that act as a radiation shield which improves the ability to keep radioactive waste contained. The bitumen substance can be asphalt or tar, which include properties that act as neutron blockers. Moreover, the bitumen substance includes properties that are climate and weather resistant.

More specifically, and in one embodiment, a method to shield radiation is provided. A bitumen substance is added to radioactive waste to create a bitumen-radioactive waste mixture. A container is filled with the bitumen-radioactive waste mixture for storage and/or transport.

In still another embodiment, a method for providing a radiation shield is presented. Leaded glass is acquired at particles sizes having diameters of 2 millimeters or less. The particles are mixed with a bitumen substance and the bitumen-glass particle mixture is coating onto a product.

In yet another embodiment, a radiation shielding system is taught. The radiation shielding system includes a bitumen substance and radioactive waste. The bitumen substance is mixed with the radioactive waste to create a bitumen-radioactive mixture.

Still other aspects of the present invention will become apparent to those of ordinary skill in the art from the following description of various embodiments. As will be realized the invention is capable of other embodiments, all without departing from the present invention. Accordingly, the drawings and descriptions are illustrative in nature and not intended to be restrictive.

DETAILED DESCRIPTION OF THE INVENTION

Figure 1:
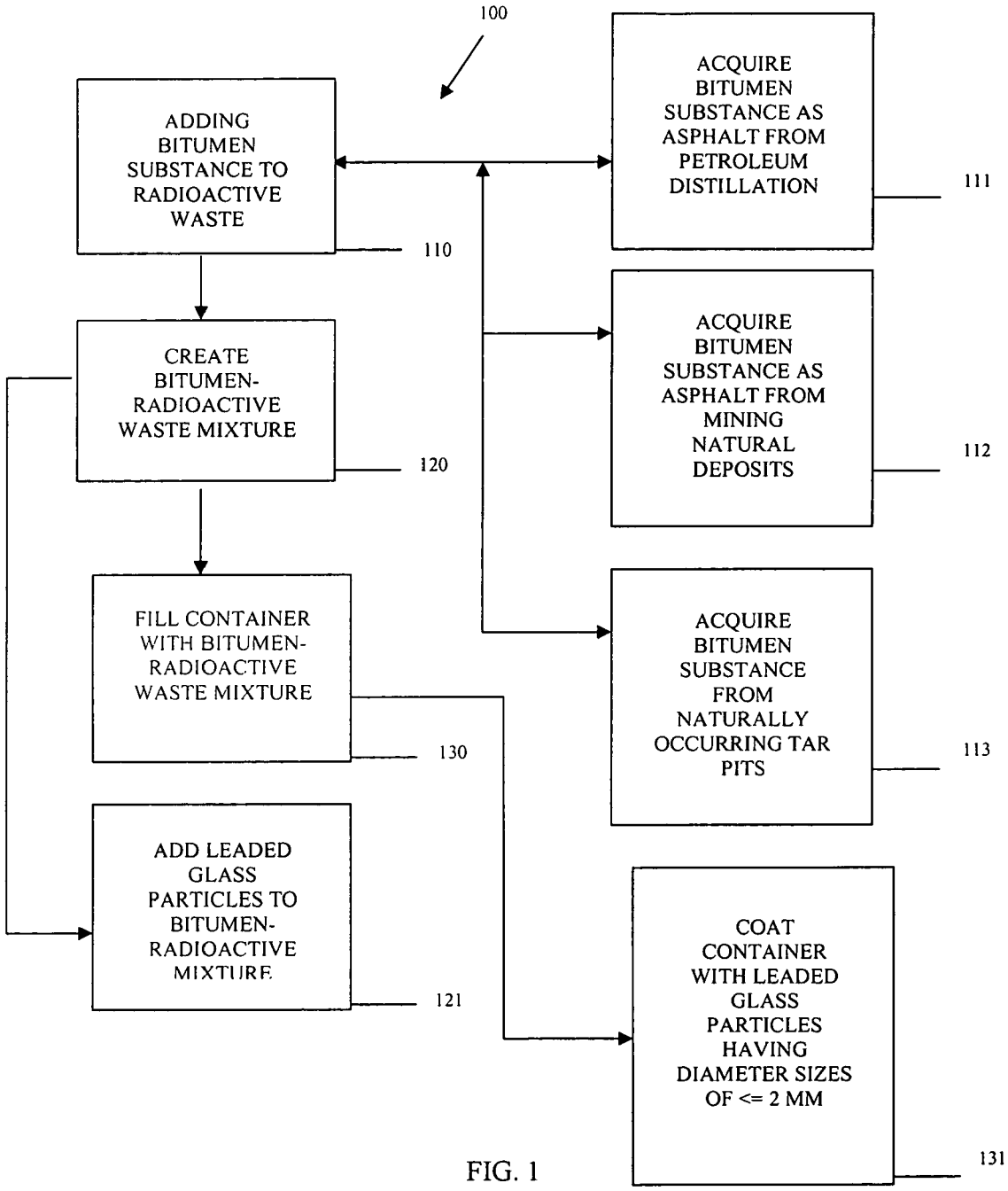
FIG. 1 is a flowchart of a method to shield radiation, according to an embodiment.

In the following description and the drawings illustrate specific embodiments of the invention sufficiently to enable those of ordinary skill in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents. The following description is, therefore, not to be taken in a limited sense, and the scope of the present invention is defined by the appended claims.

In various embodiments of the present invention, the phrase "leaded glass" is used. Leaded glass is glass that includes lead and other heavy metals (e.g., barium, bismuth, iron, tungsten, or other alloys thereof) which is not safe for disposal if not treated. Leaded glass can be found in glass waste, such as glass waste associated with television or computer monitors. The leaded glass of the present invention can be glass waste or leaded glass that is specifically manufactured (virgin glass) and produced for purposes and use in radioactive waste disposal. Leaded glass can also be leaded crystal waste or leaded crystal specifically developed for use in the teaching of the invention.

In some embodiments, where needed, leaded glass waste is treated to prevent heavy metals from leaching out of the waste when exposed to environmental forces. The technique used for treating the glass waste includes grinding the glass waste to particle sizes that are less than or equal to 2 millimeters in diameter size. The small particles are then circulated in an acid-water solution to prevent heavy metals from leaching from the small particles. These small treated particles are then capable of being used in other products and the embedded lead and heavy metals associated with the treated particles will not leach into the environment and are in fact safe for human exposure.

Further, the phrase "bitumen substance" is used herein and refers to naturally occurring bitumen substances. For example, asphalt and tar are naturally occurring bitumen substances. Asphalt can be acquired as a byproduct from petroleum distillation, such as fractional distillation where a mixture of petroleum and asphalt are separated by boiling the combined naturally occurring mixture. Correspondingly, asphalt can be acquired from oil wells and petroleum production. Asphalt can also be mined from natural deposits, such as from gravel and rock beds associated with lakes and streams. Asphalt also occurs in naturally occurring tar pits, which are more properly referred to as asphalt pits.

Tar is another bitumen substance that can be derived from the destructive distillation of organic matter. Most tar is produced from coal as a byproduct of coke production, but tar may also be produced from petroleum, wood, and peat productions. Bitumen substances have unique properties, such that they are weather and climate resistant, are good binding agents, are strong substances, and are good neutron blockers. Accordingly, in various embodiments presented herein, bitumen is used to assist in radiation shielding of radioactive waste. The properties of the bitumen substance not only assist in radiation shielding but can also assist in containing and safely transporting radioactive waste, which will be described in greater detail with the description that follows.

FIG. 1 illustrates a flowchart of one method 100 for shielding radiation. The method 100 is integrated with or supplements a radiation containment process. Thus, the method 100 is processed with devices, procedures, facilities, and materials that are used in radioactive waste disposal and/or in treating leaded glass waste.

The radiation containment process can be any conventionally used processed that is used for high-level radiation disposal (e.g. spent nuclear fuel waste) or low-level radiation disposal (e.g., objects exposed to radiation that remain harmful for human or environmental exposure). Thus, the radiation containment process can include a synroc process or a thickening process. In the synroc process the radioactive waste is mixed with other materials (e.g., concrete, and other substances) to produce a synthetic radioactive absorbing rock. In the thickening process, materials are mixed with radioactive liquid waste (e.g., radioactive waste treatment water and the like) in order to thicken the radioactive liquid waste for purposes of disposal in storage containers. The radiation containment process can be any existing or as yet undeveloped process that is modified with the teachings of the present invention.

A bitumen substance, such as asphalt or tar, is added or mixed with radioactive waste at 110. The bitumen substance can be acquired from a variety of sources. For example, at 111, the bitumen is acquired as asphalt from the byproducts associated with petroleum production or distillation. Asphalt may also be acquired, at 112, from mining natural deposits, or from naturally occurring tar pits (asphalt pits) at 113. In some embodiments, the bitumen substance is tar and acquired from sources where tar is typically found or produced (coal, petroleum, wood or peat).

Mixing the acquired bitumen substance with the radioactive waste creates a bitumen-radioactive waste mixture at 120. The bitumen-radioactive waste mixture carries the properties of the original bitumen substance, such that it has neutron blocking capabilities and is weather and climate resistant.

Moreover, the bitumen-radioactive waste mixture has a consistency and flow which are typically associated with bitumen substances. As a result, the combined mixture forms a blob or gel that if punctured may actually self seal and rebind with itself. Additionally, the blob or gel has restrictive flow and viscosity which prevents the radioactive material from separating or oozing out of the blob or gel. This is beneficial should the combined mixture be stored or transported in that it helps safely contain the radioactive waste even if a storage container is punctured or an accident occurs during transport.

In some embodiments, at 121, leaded glass particles are also added to the bitumen-radioactive waste mixture. This new mixture exhibits the beneficial radiation shielding associated with lead or other heavy metals which are included in the glass. Benefits and techniques associated with mixing leaded glass with radioactive waste can be found in co-pending and commonly assigned U.S. application Ser. No. 10/723,393, the disclosure of which is incorporated by reference herein.

At 130, a container is filled with the bitumen-radioactive waste mixture. The bitumen-radioactive waste mixture may be housed in the container for purposes of permanently storing the bitumen-radioactive waste mixture or for purposes of transporting the bitumen-radioactive waste mixture. In some embodiments, at 130, the bitumen-radioactive waste mixture also includes the leaded glass particles from 121 to enhance the radiation shielding capabilities.

In another embodiment, the container is coated with leaded glass particles having diameter sizes of less than or equal to 2 millimeters. The small leaded glass particles may optionally be treated before being applied to the container so as to remove surface heavy metals and so as to prevent the lead and other heavy metals associated with the glass from leaching into the environment. Moreover, the small glass particles can be combined with other conventional paints, sealants, plastics, or adhesives before coating the container.

In some embodiments, the inside and outside of the container is entirely coated with the small glass particles before the container is filled with the bitumen-radioactive waste mixture. In other embodiment, only the outside or only the inside of the container is coated with the small glass particles. Furthermore, the coating of the small glass particles can be used when no leaded glass is mixed with the bitumen-radioactive waste mixture or can be used when leaded glass is mixed with the bitumen-radioactive waste mixture.

By mixing the bitumen substance with the radioactive waste better neutron blocking occurs with the radioactive waste. Additionally, the resulting mixture exhibits the beneficial carrier properties associated with bitumen in terms of resistance and flow. Moreover, by adding the beneficial radiation shielding associated with leaded glass, in some embodiments, the radioactive waste is even further contained for purposes of transport and/or disposal.

Figure 2:
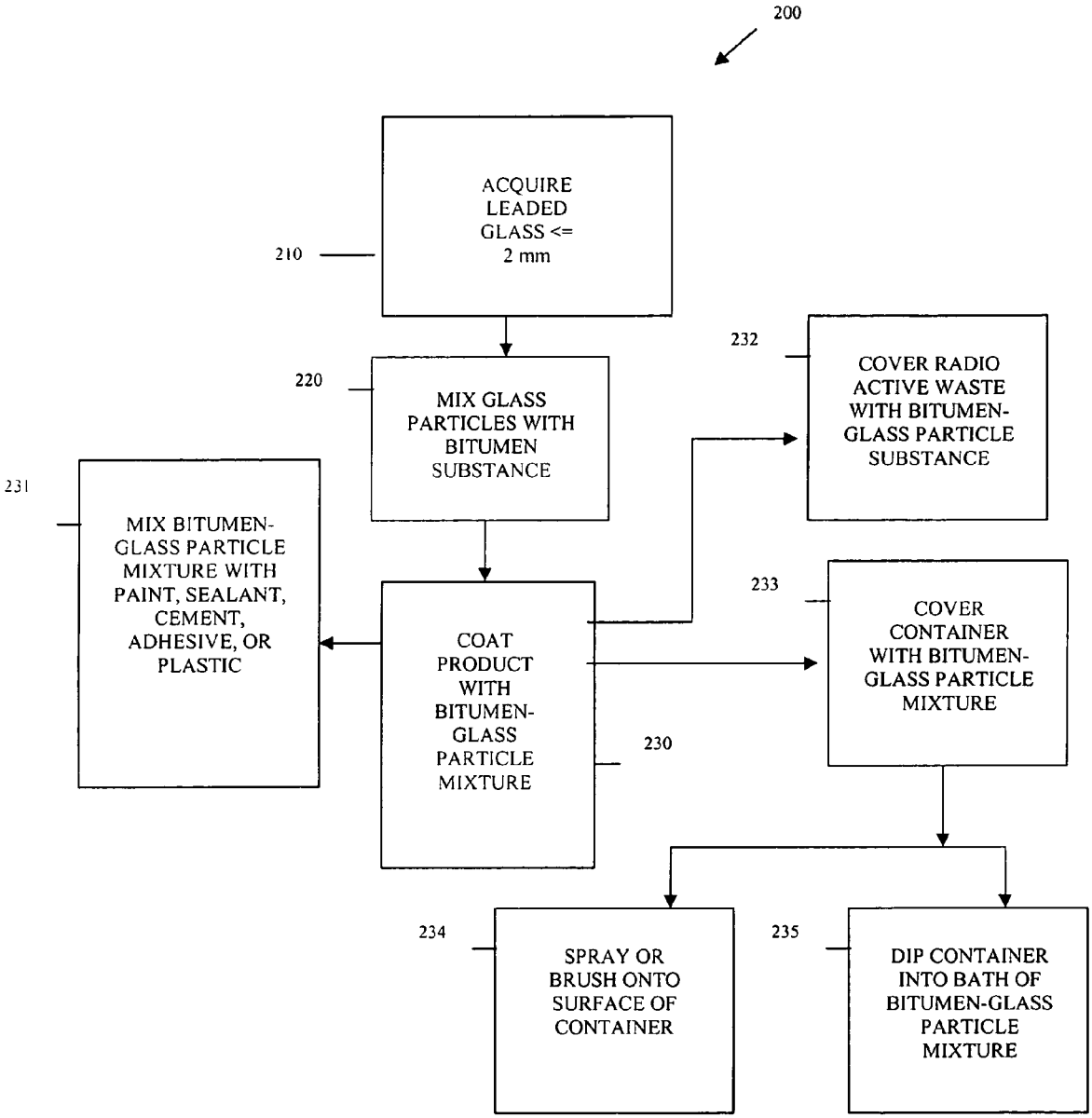
FIG. 2 is a flowchart of a method for providing a radiation shield, according to an embodiment.

FIG. 2 is a method 200 for providing a radiation shield for a product. The product can be non-radioactive waste, such as foams, adhesives, paints, sealants, and other products. Alternatively, the product can be radioactive waste modified or unmodified in a radiation containment process. An example of modified radioactive waste is synroc that includes radioactive waste and concrete to form a synthetic rock.

Unlike method 100 of FIG. 1 where radioactive waste was directly mixed with a bitumen substance, method 200 mixes leaded glass having diameter sizes of 2 millimeters or less with a bitumen substance. This combined bitumen-glass particle mixture can then be combined with a variety of products to enhance radiation shielding.

At 210, leaded glass particles having diameter sizes of 2 millimeters or less are acquired. These small glass particles may be treated in an acid-water bath and rinsed to remove surface lead and other heavy metals in order to prevent the heavy metals from leaching into the environment. At 220, the glass particles are mixed with a bitumen substance. Again, the bitumen substance can be naturally occurring asphalt, tar, or a combination of asphalt and tar. This mixture creates a bitumen-glass particle mixture.

Again it should be noted that with embodiments of FIG. 2, the glass particles can be treated in an acid-water solution to remove lead and other heavy metals that might leach from the surface of the glass particles. Alternatively, the glass particles can be acquired in a form that has already been treated, such that the lead and other heavy metals are not practically capable of leaching from the particles.

At 230, a product is coated with the bitumen-glass particle mixture. This coating provides radiation and neutron shielding which is weather and climate resistant. Consequently, the bitumen-glass particle mixture is ideal for sealing containers that house radioactive waste and can also be used to coat the outside surfaces of radioactive waste or composite mixtures having radioactive waste (e.g., synroc).

In one embodiment, at 231, the bitumen-glass particle mixture is mixed with paints, sealants, cements, adhesives, plastics, or other materials, such that the bitumen-glass particle mixture becomes an integral part of these products while at the same time the bitumen-glass particle mixture maintains its unique properties. The new products having the bitumen-glass particle mixture can then be used to coat other additional products to provide radiation, infrared, ultraviolet, and neutron blocking capabilities. The new products also exhibit strong bondings attributes and are weather and climate resistant.

In another embodiment, at 232, the product is radioactive waste or a synroc or solid form or mixture of radioactive waste having other substances, which is coated with the bitumen-glass particle mixture. The coating provides radiation and neutron shielding and adds desirable attributes to the radio active waste which make it more weather and climate resistant. In essence, the coating encapsulates, seals, and contains the radioactive waste, which prevents it from leaching out into the environment. This containment is useful in transporting the radioactive waste and/or in permanently disposing of the radioactive waste.

In yet another embodiment, at 233, the product that is being coated is a container that houses the radioactive waste. The container is covered with the bitumen-glass particle mixture to create an improved radioactive container having radiation and neutron shielding capabilities and the container is more weather and climate resistant. The bitumen-glass particle mixture can be applied so as to cover the entire surface area of the container (inside and out), or alternatively the bitumen-glass particle mixture can be applied to only an inside or outside surface area of the container. Moreover, the bitumen-glass particle mixture can be sprayed or brushed onto the container as depicted at 234 or dipped, at 235, into a bath of the bitumen-glass particle mixture.

In still other embodiments, the coating, at 230, can actually be a process that integrates the bitumen-glass particle mixture into the native composition of the product. That is, the bitumen-glass particle mixture can be melted and mixed with raw materials of the product in order to completely coat or integrate with the product. This may be useful in the creation of radioactive containers that are made of metals, plastics, or derivatives thereof.

Figure 3:
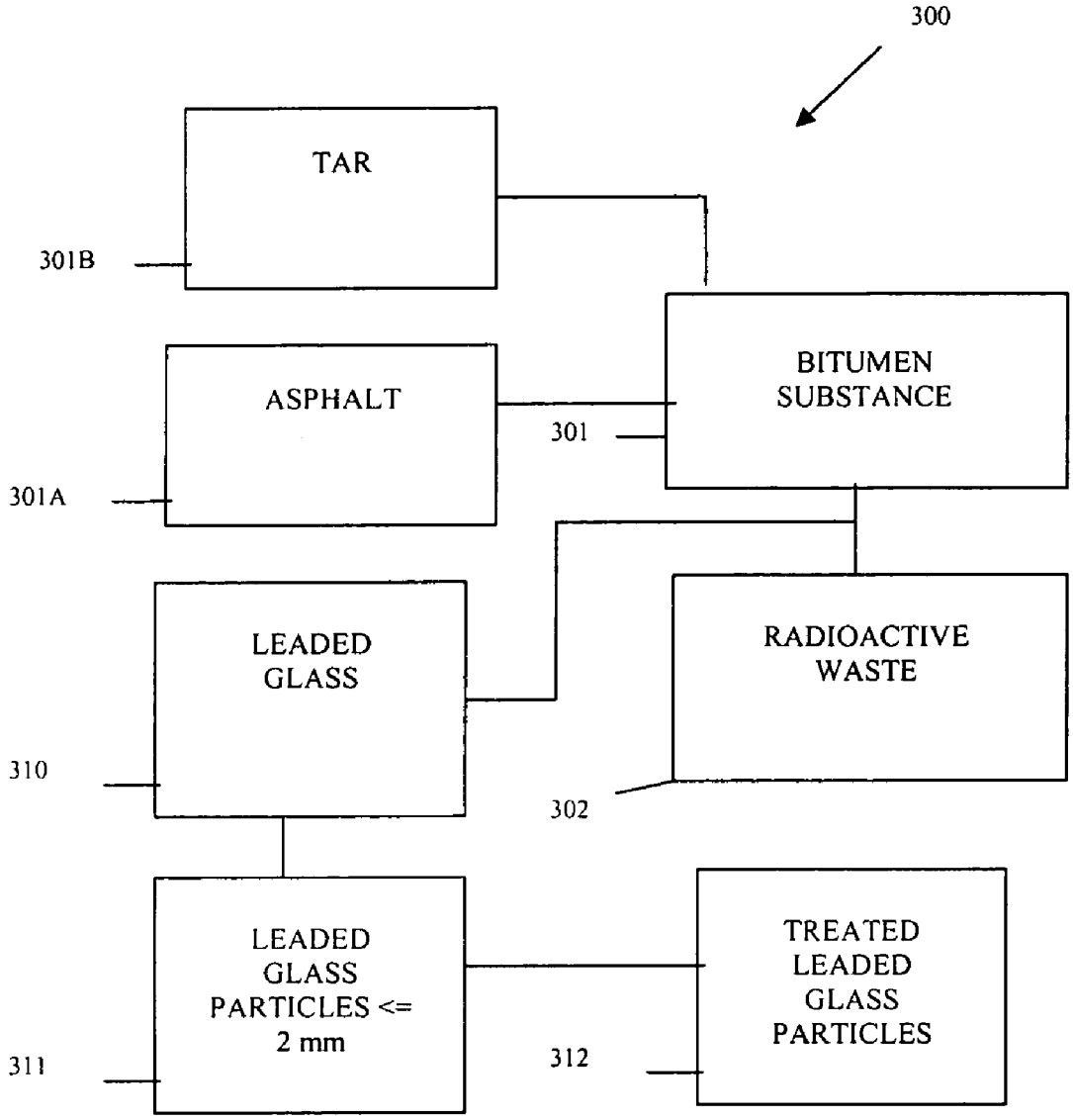
FIG. 3 is a diagram of a radiation shielding system, according to an embodiment.

FIG. 3 is a radiation shielding system 300. The radiation shielding system 300 can be a custom or conventional shielding system that is modified according to the teachings presented herein. Moreover, conventional devices used for shielding systems can be used with the embodiments of this invention.

The radiation shielding system 300 minimally includes a bitumen substance 301 and radioactive waste 302. Again, the bitumen substance 301 can be any naturally occurring asphalt 301A, tar 301B, or combinations and derivatives thereof. The bitumen substance is mixed or integrated with the radioactive waste. In some embodiments, the radioactive waste can be waste water, such that by adding the bitumen substance the new bitumen-radioactive waste mixture becomes less viscous and thicker almost like a gel. This helps in containing the waste water and aids in disposal and transport thereof. In other embodiments, the bitumen substance is mixed with the composite materials (e.g., synroc) that include both radioactive waste and other materials (e.g., cement, etc.).

In one embodiment, the radiation shielding system 300 also includes leaded glass particles 310. The leaded glass particles can also be mixed with the bitumen-radioactive waste mixture. Again, the leaded glass provides good radiation shielding capabilities because of the lead and other heavy metals contained in the leaded glass. That leaded glass can be acquired as waste materials from disposal facilities or specifically manufactured for purposes of being mixed with the bitumen-radioactive waste mixture.

In still other embodiments, the leaded glass 311 may be acquired or ground into glass particles having diameter sizes of 2 millimeters or less. At these small particles sizes the glass particles 311 exhibit beneficial properties, such that they are not practically capable of being fractured. This means that the lead and other heavy metals contained within the composition of the glass particles 311 are fully contained and will not leach out into the environment. The small glass particles 311 also provide other benefits in that at these small particle sizes the glass particles 311 can be used as fillers and are in a powder form, which means that the glass particles 311 are easily mixed with other substances. Moreover, the small glass particles 311 continue to act as good radiation shield, ultraviolet shield, and infrared shield. Thus, these small glass particles 311 can augment the bitumen-radioactive waste mixture to further enhance radioactive containment and shielding of the native radioactive waste.

In some cases, the small glass particles 311 can be treated or acquired in a treated form. The treated glass particles 312 have surface lead and other heavy metals removed from their surfaces. Thus, the only way in which lead or other heavy metal will leach from the treated glass particles 312 is if the particles are individually fractured. However, no practical or naturally occurring force is capable of fracturing the treated glass particles 312 when those particles have diameter sizes of 2 millimeters or less. Thus, the treated glass particles 312 are safe for human exposure and environmental use.

The treated glass particles 312 can be painted or used to cover the entire outer surface of the bitumen-radio active waste mixture. That coating can include other paints, sealants, adhesives, etc. Also, in some embodiments, the treated glass particles 312 can be coated or integrated into containers that house the bitumen-radioactive waste mixture. In some cases, the treated glass particles 312 can be combined with the bitumen-substance and used as an additional coating to the bitumen-radioactive waste mixture or containers housing the bitumen-radioactive waste substance. In still other embodiments, the treated glass particles 312 can be mixed with cement and used as a container for the bitumen-radioactive waste substance.

One of ordinary skill in the art readily appreciates that a variety of configurations and mixtures can be achieved and used in radioactive containment and disposal with the teachings of this invention. These configurations may only include the addition of the bitumen substance or may include combinations and aggregates of bitumen substances, leaded glass, leaded glass at small particles sizes (2 millimeters or less), and leaded glass at small particle sizes which are treated to remove surface lead and other heavy metals. All such combinations and aggregates are intended to fall within the broad scope of the present invention.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to one of ordinary skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. § 1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

The invention claimed is:

1. A method to shield radiation, comprising:

adding a bitumen substance to radioactive waste to create a bitumen-radioactive waste mixture;

filling a container with the bitumen-radioactive waste mixture; and coating the container with a sealant or paint that includes leaded glass particles which have diameter sizes of less than or equal to 2 millimeters.

2. A method for providing a radiation shield, comprising:

acquiring leaded glass particles having diameter sizes of less than or equal to 2 millimeters;

mixing the glass particles with a bitumen substance to produce a bitumen-glass particle mixture; and coating a product with the bitumen-glass particle mixture.

3. The method of claim 2 wherein mixing further includes mixing the bitumen-glass particle mixture with at least one of paint, a sealant, cement, adhesive, and plastic.

4. The method of claim 2 wherein coating further includes covering radioactive waste with the bitumen-glass particle mixture, wherein the radioactive waste is the product.

5. The method of claim 2 wherein coating further includes covering a surface of a container with the bitumen-glass particle mixture, wherein the container houses radioactive waste and wherein the container is the product.

6. The method of claim 5 wherein covering further includes spraying or brushing the bitumen-glass particle mixture onto the surface.

7. The method of claim 5 wherein covering further includes dipping the container into a bath of the bitumen-glass particle mixture.

8. A radiation shielding system comprising:

a bitumen substance;

radioactive waste, wherein the bitumen substance is mixed with the radioactive waste to create a bitumen-radioactive mixture; and leaded glass particles having diameter sizes of less than or equal to 2 millimeters, wherein the glass particles are coated onto an outer surface of the bitumen-radioactive mixture.

9. The radiation shielding system of claim 8 wherein the leaded glass particles are coated onto a surface of a container that houses the bitumen-radioactive waste mixture.

10. The radiation shielding system of claim 9 wherein the leaded glass particles are treated to remove surface heavy metals before the surface of the container is coated with the leaded glass particles.

* * * * *